United States Patent [19]

Krimsky

[11] Patent Number: 4,601,116

[45] Date of Patent: Jul. 22, 1986

[54] COANDA NOZZLE DRYER

[75] Inventor: Leonard C. Krimsky, Englewood, N.J.

[73] Assignee: Worldwide Converting Machinery, Inc., Allendale, N.J.

[21] Appl. No.: 734,798

[22] Filed: May 16, 1985

[51] Int. Cl.[4] ..... F26B 13/20

[52] U.S. Cl. ..... 34/156; 34/160; 226/97

[58] Field of Search ..... 34/155, 156, 160; 226/7, 97

[56] References Cited

U.S. PATENT DOCUMENTS 3,711,960 1/1973 Overly et al. ..... 34/156
4,074,841 2/1978 Kramer et al. ..... 34/156
4,247,993 2/1981 Lindstrom ..... 34/156
4,414,757 11/1983 Whipple ..... 34/156

*Primary Examiner*—Larry I. Schwartz
*Attorney, Agent, or Firm*—Shenier & O'Connor

[57] ABSTRACT

A Coanda dryer nozzle unit in which a nozzle opening formed in a plenum chamber just below and extending along one edge of a wall of the chamber parallel to the web to be dried is connected to the upper surface of the wall by a curved surface to produce a Coanda flow of air over the curved surface and along the upper surface of the wall. A lip along the other edge of the wall has a curved surface which directs the airflow upwardly toward the web and produces a pad of air between the web and the wall.

6 Claims, 3 Drawing Figures

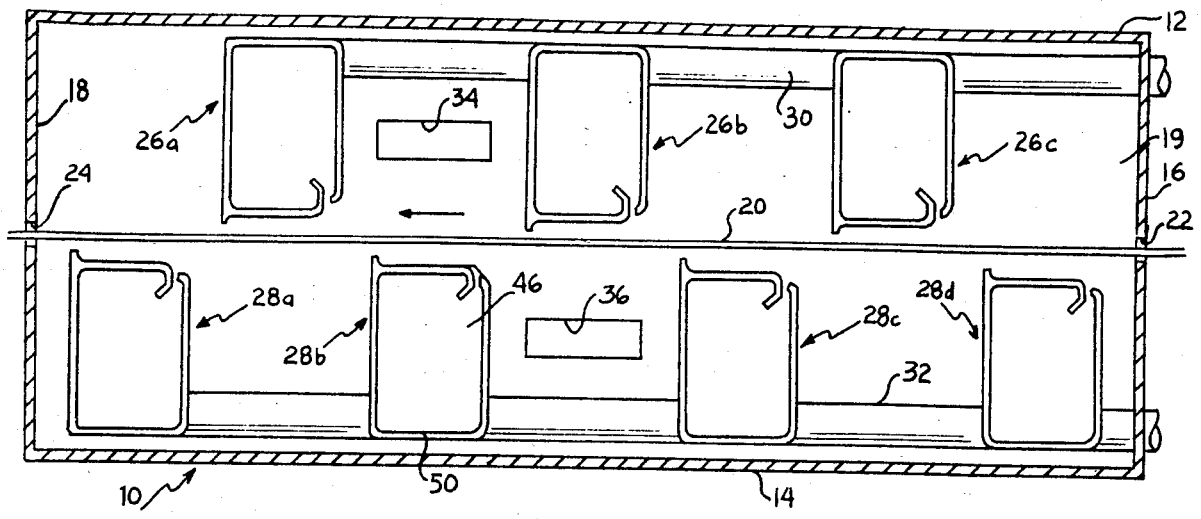
FIG. 1
FIG. 2
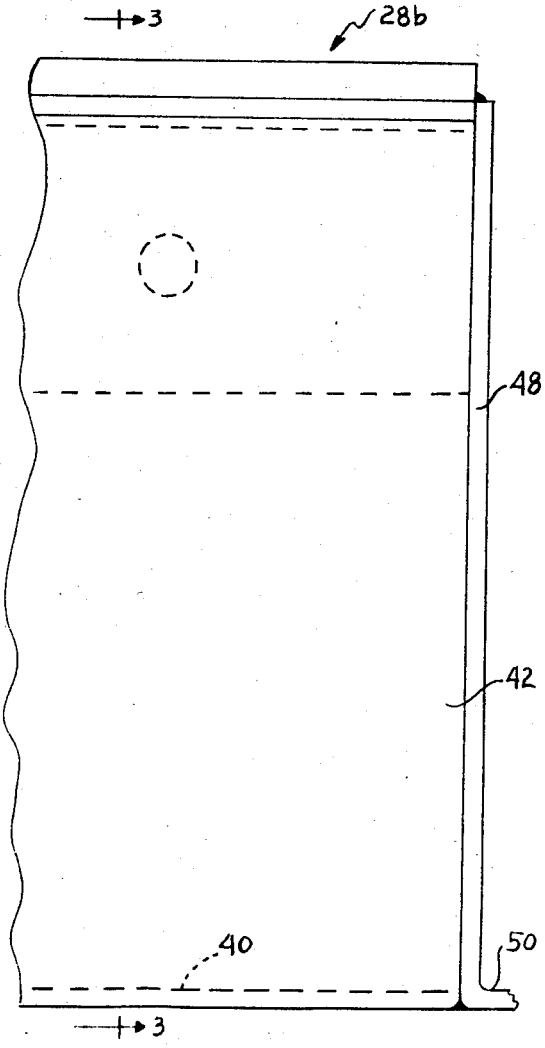
FIG. 3
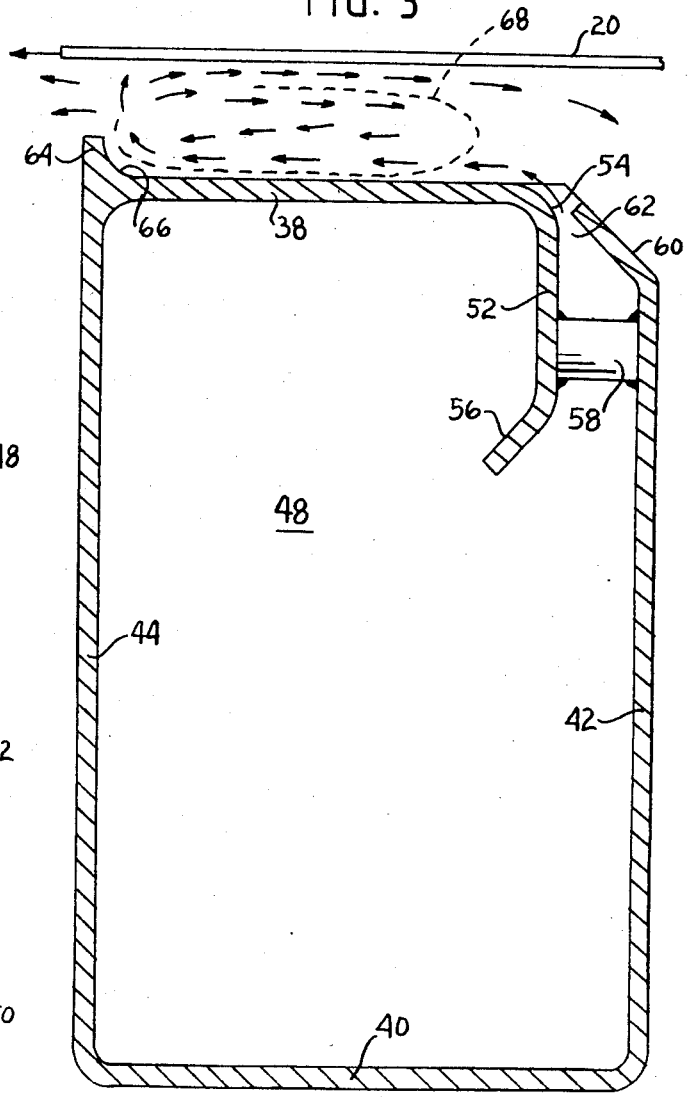

COANDA NOZZLE DRYER

FIELD OF THE INVENTION

The invention relates to a dryer for drying webs and coatings and the like, and more particularly to an improved dryer the nozzle units of which employ the Coanda effect.

BACKGROUND OF THE INVENTION

There are known in the prior art various dryers all of which make use of the Coanda effect. As is known, a significant of feature of the Coanda effect, which makes nozzles employing the effect especially suitable in dryers is the entrainment in the nozzle stream of a relatively large quantity of the surrounding air.

In most of the nozzle units employing the Coanda effect, the stream of air emerging from the nozzle travels along a curved surface into the space between a pressure plate of the nozzle and the web to be dried. U.S. Pat. No. 3,587,177 shows a dryer of this type which relies on a reduced pressure along the horizontal surface of the pressure plate created by the Bernoulli effect to hold the web close to the nozzle. This increases the possibility of flutter or instability marring the web coating. The structure shown in this patent also has an inherent instability problem at the edge at which the web leaves the airfoil. Attempts have been made to solve this problem.

U.S. Pat. No. 3,711,960 shows a dryer employing a plurality of Coanda nozzle assemblies in which respective upper and lower nozzle assemblies are arranged in staggered relationship above and below the web to be dried so as floatingly to support the web in the course of its movement through the dryer. The patentees suggest that the airfoil surface of each nozzle, which extends parallel to the web should terminte in a sharp edge to release air in a direction of flow along the web.

U.S. Pat. No. 4,414,757 discloses an improved Coanda effect nozzle assembly in which a primary Coanda airfoil nozzle directs air downstream along the face of the pressure plate toward a secondary nozzle of the impingement type for directing air substantially perpendicularly to the airflow produced by the primary nozzle. Among other effects, this secondary nozzle causes the primary air stream to form a pad of air or an increase in static pressure in the primary flow zone which assists in keeping the web spaced from the pressure plate.

U.S. Pat. No. 3,549,070 discloses a web flotation nozzle which uses a dual discharge slot. This arrangement not only requires a relatively large amount of air but also is subject to instabilities which may result from any mismatch in the two opposing jets of air.

SUMMARY OF THE INVENTION

One object of my invention is to provide an improved Coanda nozzle dryer which overcomes the defects of Coanda nozzle dryers of the prior art.

Another object of my invention is to provide an improved Coanda nozzle dryer which is simpler in construction and consequently less expensive to construct than are Coanda nozzle dryers of the prior art.

Another object of my invention is to provide an improved Coanda nozzle dryer which requires a lower volume of air than do dryers of the prior art.

Yet another object of my invention is to provide an improved Coanda nozzle dryer which provides greater spacing between the nozzle and the web being dried than do dryers of the prior art.

A further object of my invention is to provide a Coanda nozzle dryer which is less expensive to operate than are Coanda nozzle dryers of the prior art.

Still another object of my invention is to provide a Coanda nozzle dryer which is more stable in operation that are dryers of the prior art.

Other further object of my invention will appear from the following description:

BRIEF DESCRIPTION OF THE DRAWINGS

In the accompanying drawings to which reference is made in the instant specification, and which are to be read in conjunction therewith and in which like reference characters are used to indicate light parts in the various views:

FIG. 1 is a partially schematic side elevation of my improved Coanda nozzle dryer with parts removed.

FIG. 2 is a fragmentry elevation of one of the nozzle units shown in FIG. 1 drawn on an enlarged scale.

FIG. 3 is a sectional view of the nozzle unit illustrated in FIG. 2 taken along the lines 3—3 thereof.

DESCRIPTION OF THE PREFERRED EMBODIMENT

My improved Coanda nozzle dryer indicated generally by the reference character 10 is enclosed in a housing 10 having a top 12 of bottom 14 and 16 and 18 as well as a back 19 and a front (not shown). The web 20 to be dried enters the housing through a slot 22 in the end 16 and emerges from the housing through a slot 24 in the end 18.

The dryer 10 includes a plurality of upper nozzle units indicated generally by the reference characters 26*a* to 26*c* and a plurality of a lower nozzle units 28*a* through 28*d*. An upper air supply manifold 30 supplies the units 26*a* to 26*c*. A lower manifold 32 supplies the units 28*a* to 28*d* with drying gas such as air. By way of example, I provide the dryer 10 with upper and lower exhaust ports 34 and 36. While I have shown three upper nozzle units and four lower nozzle units, it will really be appreciated that as many upper and lower units are used as are necessary to effect the required drying, while at the same time floatingly supporting the web 20 in the course of its passage through the dryer.

Since all of the nozzle units 26*a* to 26*c* and 28*a* to 28*d* are substantially identical, I will describe only the unit 28*b* in detail. This unit includes a top wall 38, a bottom wall 40 and front walls 42 and 44. It will really be appreciated that each of the dryer units extends the full width of the web to be dried. I provide each of the units with a pair of end plates 46 and 48 secured to the unit by any suitable means such for example as by welding. Each of the plates 46 and 48 may be formed with a mounting flange 50.

I form each of the top wall 38 with a portion 52 bent downwardly generally vertically and bent backwardly somewhat at its lower end 56 to facilitate the entry of air into the nozzle proper. A generally arcuately curved surface portion 54 connects the portion 52 to the rest of the top wall 38 to form a Coanda surface along which a gas such as air travels to the generally horizontally extending pressure surface portion of the top wall 38. A plurality of spacers 58 held in position by any suitable means such as by welding and distributed across the width of the unit 28*b* maintain the portion 52 in properly spaced relationship to the upper portion of the front wall 42 of the unit. The upper edge of the front wall 42 is bent backwardly at 60 to form the nozzle opening 62. It will be seen that opening 62 is below the upper surface of the top wall 38.

As is known in the art, by virtue of the Coanda effect gas such as air emerging from the nozzle opening 62 tends to follow the curve of surface portion 54 and to travel from right to left among the upper pressure surface the top wall 38. In so doing, the surrounding air is entrained in the airflow emerging from the nozzle opening. I provide a lip 64 extending upper lift from the surface of top wall 38 along the rear wall 44 across the entire nozzle unit 28*b*. A curved surface 66 connecting the upper surface of the top wall 38 to the top of the lip 64 intercepts air flowing along the top wall and directs toward the web 20. This surface 66 and the lip 64 cause the air to form a pressure pad in the region enclosed by the broken line 68 in FIG. 3. This pad 68 extends over substantially the entire distance of the upper surface of the top wall 38 from the surface 54 to the surface 66. This pressure pad generally is thicker than are pressure pads formed by arrangement of the prior art with the result of increased web to nozzle clearance. In addition to providing the pad of increased thickness, the lip 64 produces an impingement heat transfer effect which enhances the drying action of the nozzle.

It will be seen that I have accomplished the objects of my invention. I have provided an improved Coanda nozzle dryer which overcomes the defects of prior dryers of this type. My dryer requires less air than similar dryers of the prior art. It provides greater clearance between the nozzles and the web being supported. It is more stable than are dryers of the prior art. It is simpler in construction and in operation.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A dryer unit for applying a drying gas to a web including in combination means forming a pressure surface adapted to be arranged generally parallel to the web to be dried, means forming a Coanda type nozzle having an opening adjacent to one end of said pressure surface and means forming a curved surface connecting said nozzle opening to said pressure surface, means for supplying said nozzle opening with drying gas to produce a Coanda flow of gas onto and along said pressure surface and means forming a mechanical barrier at the other end of said pressure surface for directing said flow of gas toward said web to produce pad of air between said pressure surface and said web.

2. A dryer unit as in claim 1 in which said barrier forming means comprises a second curved surface curving away from said pressure surface toward said web.

3. A dryer unit for applying a drying gas to a web including in combination a plenum chamber elongated in the direction of the width of the web, said plenum chamber having a pressure wall adapted to be disposed with its outer surface generally parallel to the web to be dried, means forming a Coanda type nozzle forming an opening extending across said web adjacent to one edge of said pressure wall and a curved surface connecting said nozzle opening to the outer surface of said pressure wall to produce a Coanda flow of drying gas along said curved surface and said outer surface and a lip extending across the width of the web along the other edge of the surface to intercept said flow of drying gas and direct it toward said web.

4. A dryer as in claim 3 in which said lip comprises a second curved surface curving smoothly away from the outer surface to and toward said web.

5. A dryer as in claim 4 in which said nozzle opening is disposed below said outer surface of said pressure wall.

6. A dryer as in claim 5 in which said plenum chamber comprises a front wall, said nozzle opening forming means comprising an inwardly bent portion of said pressure wall and a backwardly bent portion of said front wall.

* * * * *